US009155440B2

(12) United States Patent
Nuttall et al.

(10) Patent No.: US 9,155,440 B2
(45) Date of Patent: Oct. 13, 2015

(54) STEAM DISTRIBUTION APPARATUS AND METHODS FOR STEAM CLEANING DEVICES

(71) Applicant: ELECTROLUX HOME CARE PRODUCTS, INC., Charlotte, NC (US)

(72) Inventors: Ronald Andrew Nuttall, Concord, NC (US); Chih Kao Hsu, Taipei (TW)

(73) Assignee: Electrolux Home Care Products, Inc., Charlotte, NC (US)

( * ) Notice: Subject to any disclaimer, the term of this patent is extended or adjusted under 35 U.S.C. 154(b) by 197 days.

(21) Appl. No.: 13/833,571

(22) Filed: Mar. 15, 2013

(65) Prior Publication Data

US 2014/0259515 A1 Sep. 18, 2014

(51) Int. Cl.

| | |
|---|---|
| ***A47L 7/00*** | (2006.01) |
| ***A47L 11/34*** | (2006.01) |
| ***A47L 11/40*** | (2006.01) |
| ***A47L 13/22*** | (2006.01) |

(52) U.S. Cl.

CPC ..... *A47L 11/34* (2013.01); *A47L 11/4075* (2013.01); *A47L 11/4086* (2013.01); *A47L 11/4088* (2013.01); *A47L 13/225* (2013.01)

(58) Field of Classification Search

USPC ..... 15/320, 321, 328

See application file for complete search history.

(56) References Cited

U.S. PATENT DOCUMENTS

| | | | |
|---|---|---|---|
| 1,563,829 | A | 12/1925 | Brown |
| 2,205,535 | A | 6/1940 | Muckenhirn |
| 2,310,011 | A | 2/1943 | Cave |
| 2,469,060 | A | 5/1949 | Vosbikian |
| 2,678,458 | A | 5/1954 | Vosbikian |
| 2,764,774 | A | 10/1956 | Belsky |
| 2,804,638 | A | 9/1957 | Vosbikian |
| 3,006,668 | A | 10/1961 | Stewart |

(Continued)

FOREIGN PATENT DOCUMENTS

| | | |
|---|---|---|
| DE | 19908259 | 8/2000 |
| EP | 0426209 | 5/1991 |
| EP | 0430846 | 6/1991 |
| EP | 1985221 | 10/2008 |
| GB | 2276811 | 10/1994 |
| WO | 9740736 | 11/1997 |

OTHER PUBLICATIONS

Entire patent prosecution history of U.S. Appl. No. 14/035,431, filed Sep. 24, 2013, entitled, "Flexible Scrubbing Head Fora Floor Mop."

(Continued)

*Primary Examiner* — Lee D Wilson
*Assistant Examiner* — Shantese McDonald
(74) *Attorney, Agent, or Firm* — RatnerPrestia

(57) ABSTRACT

A steam cleaner having a base with a bottom and a sidewall extending from the bottom to form an outer perimeter of the base, and a handle extending from the base. A fluid tank and a steam generator are operatively associated with the handle or the base. The steam generator receives fluid from the fluid tank and convert it into steam. A first control selectively operates the steam generator. The base has a bottom steam distributor on the bottom of the base and a side steam distributor on the sidewall or a top wall of the base. The bottom distributor distributes the steam towards a first region located within the outer perimeter of the base. The side distributor distributes the steam towards a second region located outside the outer perimeter of the base. A second control selects whether to distribute steam through the bottom or side distributor.

40 Claims, 5 Drawing Sheets

(56) References Cited

U.S. PATENT DOCUMENTS 3,050,762 A 8/1962 Ballinger
3,362,037 A 1/1968 Griffin
3,395,415 A 8/1968 Leland
3,440,677 A 4/1969 Flomerfelt
3,656,202 A 4/1972 Paton
3,720,974 A 3/1973 Rosendall
3,792,505 A 2/1974 Saltzstein
3,850,533 A 11/1974 Thielen
4,031,673 A 6/1977 Hagelberg
4,068,340 A 1/1978 Forward
4,127,911 A 12/1978 Cupp
4,165,550 A 8/1979 Burke
4,219,899 A 9/1980 Zurawin
4,299,262 A 11/1981 Andrepont
4,327,459 A 5/1982 Gilbert
4,392,269 A 7/1983 Nishiyama
4,433,451 A 2/1984 Parisi
4,658,461 A 4/1987 Roe
4,845,800 A 7/1989 Pederson
4,858,962 A 8/1989 Bölling et al.
4,864,675 A 9/1989 Jones
4,926,515 A 5/1990 Lynn
5,067,400 A 11/1991 Bezella
5,133,101 A 7/1992 Hauser
5,232,298 A 8/1993 Mitsunari et al.
5,323,506 A 6/1994 Babitch
5,341,541 A 8/1994 Sham
5,377,378 A 1/1995 Cutler
5,386,612 A 2/1995 Sham
5,502,872 A 4/1996 Chae et al.
5,581,839 A 12/1996 Ferrell, Jr.
5,584,091 A 12/1996 Borofsky
5,591,507 A 1/1997 Jones
5,613,271 A 3/1997 Thomas
5,625,918 A 5/1997 Kieson
5,876,141 A 3/1999 Hsu
5,881,423 A 3/1999 Shumway
5,887,314 A 3/1999 Jordan, Jr.
5,888,006 A 3/1999 Ping et al.
5,901,402 A 5/1999 Williams
5,920,952 A 7/1999 Baldacci
5,988,920 A 11/1999 Kunkler et al.
6,003,191 A 12/1999 Sherry
6,087,279 A 7/2000 Laun
6,101,661 A 8/2000 Policicchio
6,119,298 A 9/2000 Kenmochi
6,148,144 A 11/2000 Milanese
6,289,551 B1 9/2001 Basile
6,305,046 B1 10/2001 Kingry
6,336,240 B1 1/2002 Laux
6,397,427 B1 6/2002 Bryngelsson
6,453,506 B1 9/2002 Sumner
6,463,620 B2 10/2002 Busha
6,487,746 B1 12/2002 Cioci
6,502,275 B1 1/2003 Hsieh
6,540,424 B1 4/2003 Hall et al.
6,546,584 B2 4/2003 Hobden
6,571,421 B1 * 6/2003 Sham et al. ..... 15/320
6,579,023 B2 6/2003 Kunkler et al.
6,584,990 B2 7/2003 Shaw
6,591,442 B2 7/2003 Kaminstein
6,606,757 B2 8/2003 Vosbikian
6,640,383 B2 11/2003 Tsen
6,663,306 B2 12/2003 Policicchio et al.
6,669,391 B2 12/2003 Policicchio et al.
6,692,172 B1 2/2004 Hsu
6,716,805 B1 4/2004 Sherry et al.
6,722,806 B2 4/2004 Kunkler et al.
6,814,519 B2 11/2004 Policicchio et al.
6,820,301 B2 11/2004 Petner
6,823,559 B2 11/2004 Kaffenberger et al.
6,836,921 B1 1/2005 Petner
6,842,936 B2 1/2005 Policicchio
6,854,911 B2 2/2005 Policicchio et al.
6,871,372 B2 3/2005 Vosbikian
6,889,917 B2 5/2005 Fahy et al.
6,892,415 B2 5/2005 Libman
6,893,180 B2 5/2005 Hall et al.
6,899,485 B2 5/2005 Hall et al.
6,910,823 B2 6/2005 Policicchio et al.
6,934,995 B2 8/2005 Wheeler et al.
6,948,873 B2 9/2005 Policicchio et al.
6,953,299 B2 10/2005 Wang
6,964,535 B2 11/2005 Bell et al.
6,976,802 B2 12/2005 Hall et al.
6,986,618 B2 1/2006 Hall et al.
6,990,708 B2 1/2006 Rosa et al.
7,007,338 B2 3/2006 Garabedian, Jr.
7,028,364 B2 4/2006 Policicchio et al.
7,033,965 B2 4/2006 Takabayashi
7,048,804 B2 5/2006 Kisela et al.
7,055,204 B2 6/2006 Ajluni
7,059,011 B2 * 6/2006 Capitani ..... 15/320
7,096,531 B2 8/2006 Policicchio
7,124,464 B2 10/2006 Williams
7,127,772 B2 10/2006 Dingert
7,137,169 B2 11/2006 Murphy et al.
7,144,173 B2 12/2006 Policicchio et al.
7,163,349 B2 1/2007 Policicchio et al.
7,182,537 B2 2/2007 Policicchio et al.
7,185,392 B2 3/2007 Murray
7,225,495 B2 6/2007 Berti
7,264,413 B2 9/2007 Vosbikian
7,293,322 B2 11/2007 Matousek et al.
7,313,843 B2 1/2008 Brinker
7,343,638 B2 3/2008 Mitchell
7,350,257 B2 4/2008 McKay
7,380,307 B2 * 6/2008 Tsai ..... 15/320
7,428,768 B2 9/2008 Dingert
7,465,115 B2 12/2008 Suda et al.
7,536,743 B2 5/2009 Goh
7,566,671 B2 7/2009 Hoadley et al.
7,574,768 B2 8/2009 Morris
7,618,206 B2 11/2009 Sacks
7,640,626 B2 * 1/2010 Oh ..... 15/387
7,648,303 B2 1/2010 Zorzo
7,665,180 B2 2/2010 Haan
7,699,551 B2 4/2010 Suda
7,721,381 B2 5/2010 Michelson
7,740,193 B2 6/2010 Soller et al.
7,779,501 B2 8/2010 Lacotta
7,841,039 B1 11/2010 Squire
7,841,040 B2 11/2010 Strunk
7,856,691 B2 12/2010 Viggiani
7,891,047 B2 * 2/2011 Milanese ..... 15/320
7,895,697 B2 3/2011 Cassar
7,930,798 B2 4/2011 Zhou et al.
8,052,342 B2 11/2011 Rosenzweig et al.
8,056,181 B2 11/2011 Kim et al.
8,069,520 B2 12/2011 Mattucci
8,142,094 B2 3/2012 Kaleta et al.
8,166,597 B2 5/2012 Levitt
8,171,592 B2 5/2012 Tsai
8,186,898 B2 5/2012 Bradbury et al.
8,205,288 B2 6/2012 Broman
8,205,293 B2 6/2012 Rosenzweig et al.
8,239,999 B2 8/2012 Hsu
8,245,351 B2 8/2012 Rosenzweig et al.
8,250,700 B2 8/2012 Pung
8,261,402 B2 9/2012 Rosenzweig et al.
8,267,607 B2 9/2012 Harris
8,276,234 B2 10/2012 Hsu
8,286,294 B2 10/2012 Cassar
8,407,848 B2 4/2013 Pung
8,449,682 B2 5/2013 Perelli
8,464,389 B2 6/2013 Jiang
8,464,391 B2 6/2013 Bober
2002/0194693 A1 12/2002 Wu
2003/0028988 A1 2/2003 Streutker
2003/0044569 A1 3/2003 Kacher
2003/0126710 A1 7/2003 Policicchio
2004/0146332 A1 7/2004 Fu
2004/0231700 A1 11/2004 Bell
2007/0130713 A1 6/2007 Chen

(56) References Cited

U.S. PATENT DOCUMENTS

| | | | |
|---|---|---|---|
| 2008/0222825 | A1 | 9/2008 | Sampaio |
| 2009/0235476 | A1 | 9/2009 | Cioci |
| 2009/0249570 | A1 | 10/2009 | Rosenzweig |
| 2010/0199455 | A1 | 8/2010 | Vrdoljak |
| 2011/0167583 | A1 | 7/2011 | Weaver |
| 2011/0185529 | A1 | 8/2011 | Kandasamy |
| 2011/0219581 | A1 | 9/2011 | Vines et al. |
| 2011/0223375 | A1 | 9/2011 | Kaminer et al. |
| 2012/0195674 | A1 | 8/2012 | Mandle |
| 2012/0269567 | A1 | 10/2012 | Crawford |
| 2013/0067673 | A1 | 3/2013 | Yu |

OTHER PUBLICATIONS

Entire patent prosecution history of U.S. Appl. No. 14/035,455, filed Sep. 24, 2013, entitled, "Sliding Scrub Brush Fora Floor Mop."
Entire patent prosecution history of U.S. Appl. No. 14/035,472, filed Sep. 24, 2013, entitled, "Floor Mop With Concentrated Cleaning Feature."
Entire patent prosecution history of U.S. Appl. No. 14/043,346, filed Oct. 1, 2013, entitled, "Floor Mop With Removable Base Plate."
Photographs of Dirt Devil Products publicly available before Sep. 24, 2013, 6 pages.
Office Action mailed Mar. 10, 2015 for U.S. Appl. No. 14/043,346.
Office Action mailed Mar. 11, 2015 for U.S. Appl. No. 14/035,455.

* cited by examiner

FIG. 4
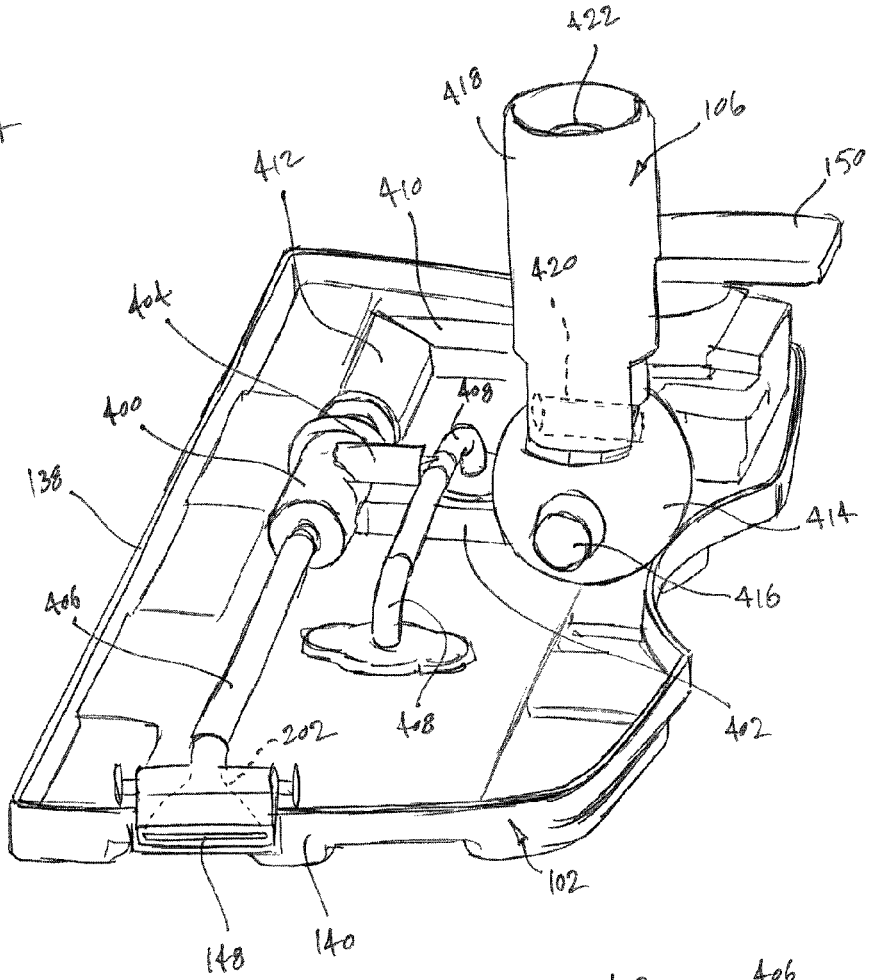
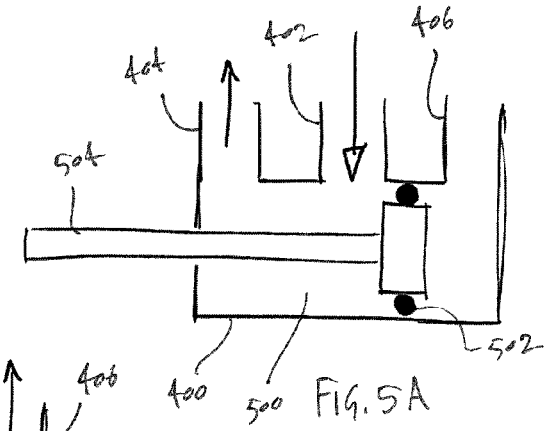
FIG. 5A
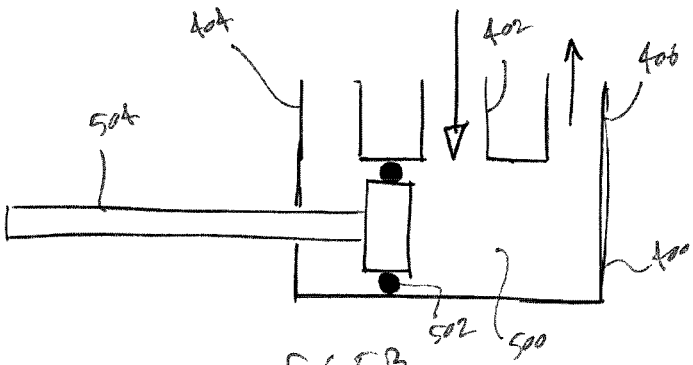
FIG. 5B

STEAM DISTRIBUTION APPARATUS AND METHODS FOR STEAM CLEANING DEVICES

BACKGROUND OF THE INVENTION

1. Field of the Invention

The present invention relates to portable steam cleaners for general household or commercial use, and, more specifically, to systems and methods for redistributing the flow of steam to focus cleaning efforts on particular locations.

2. Description of the Related Art

Steam cleaning devices are commonly used to clean hard floor surfaces such as tile, vinyl, wood, and the like. Such devices operate on the principle of using steam or very warm water to break up encrusted grime, sticky and oily substances, and the like. Examples of steam cleaners are shown in U.S. Pat. Nos. 4,433,451; 5,502,872; 5,920,952; 6,148,144; and 8,052,342, which are incorporated herein by reference.

Such steam cleaners employ a variety of steam vent arrangements to deposit the steam on the underlying surface. For example, the device in U.S. Pat. No. 4,433,451 distributed steam via a "spray hose" having a number of spaced openings directly facing the underlying surface. As another example, U.S. Pat. No. 6,289,551, which is also incorporated herein by reference, selectively distributes steam to different zones located below the cleaning head. Such devices covers all of the steam outlets, making it impossible to accurately assess cleaning performance or even which vents are in operation.

Known steam cleaners also use various types of heater. For example, the device shown in U.S. Pat. No. 5,920,952 uses a steam tank, whereas the device in U.S. Pat. No. 6,571,421 uses an "instantaneous" heater that provides on-demand steam generation that converts fluid to steam as it passes through the heating block's internal passages, and does not have a separate steam tank. The foregoing patents are incorporated herein by reference.

It is also known to use steam cleaners in conjunction with vacuum cleaners, such as shown in U.S. Pat. Nos. 4,433,451 and 6,571,421. Known steam cleaners also employ a variety of fluid tank and steam generator locations, and use devices such as dry-break valves to provide removable supply tanks, induction heaters, immersion heaters, and so on.

Despite the prior use and design of steam cleaners, there still exists a need to provide enhanced cleaning performance, and more user-friendly systems.

SUMMARY

In one exemplary embodiment, there is provided a steam cleaner having a base and an operating handle connected to and extending from the base. The base has a generally flat bottom configured to rest on a surface to be cleaned, a sidewall extending upwards from the bottom and forming an outer perimeter of the base, and a top joining the sidewall. A fluid tank is operatively associated with the handle or the base and configured to contain a fluid. A steam generator is operatively associated with the handle or the base and fluidly connected to the fluid tank to receive the fluid from the fluid tank and convert the fluid into a steam flow. A first control is provided to selectively operate the steam generator. A bottom steam distributor is located on the bottom of the base. The bottom steam distributor is operable, upon activation, to distribute the steam flow from the bottom of the base towards a first region of the surface to be cleaned located within the outer perimeter of the base. A side steam distributor is also located on the base. The side steam distributor is operable, upon activation, to distribute at least a portion of the steam flow towards a second region of the surface to be cleaned located outside the outer perimeter of the base. A second control is provided to be movable between a first position in which the second control fluidly connects the steam generator to the bottom steam distributor to activate the bottom steam distributor, and a second position in which the second control fluidly connects the steam generator to the side steam distributor to activate the side steam distributor.

The recitation of this summary of the invention is not intended to limit the claims of this or any related or unrelated application. Other aspects, embodiments, modifications to and features of the claimed invention will be apparent to persons of ordinary skill in view of the disclosures herein.

BRIEF DESCRIPTION OF THE DRAWINGS

A better understanding of the exemplary embodiments may be understood by reference to the attached drawings, in which like reference numbers designate like parts. The drawings are exemplary and not intended to limit the claims in any way.

FIG. 4 is an isometric side view of the base of the steam cleaner of FIG. 1, shown with the top cover removed.

FIGS. 5A and 5B schematically illustrate the operation of an exemplary steam valve.

DETAILED DESCRIPTION

The following description provides examples of steam cleaning apparatus and devices in the context of an upright portable steam cleaner. It will be appreciated that embodiments of the invention may be incorporated into other cleaning systems to create hybrid cleaners. For example, devices disclosed herein may be mounted on an upright or canister vacuum cleaner to provide a combined steam/vacuum cleaner. Other variations will be apparent to persons of ordinary skill in the art in view of the present disclosure, and the invention is not intended to be limited to the exemplary embodiments set forth herein.

Figure 1:
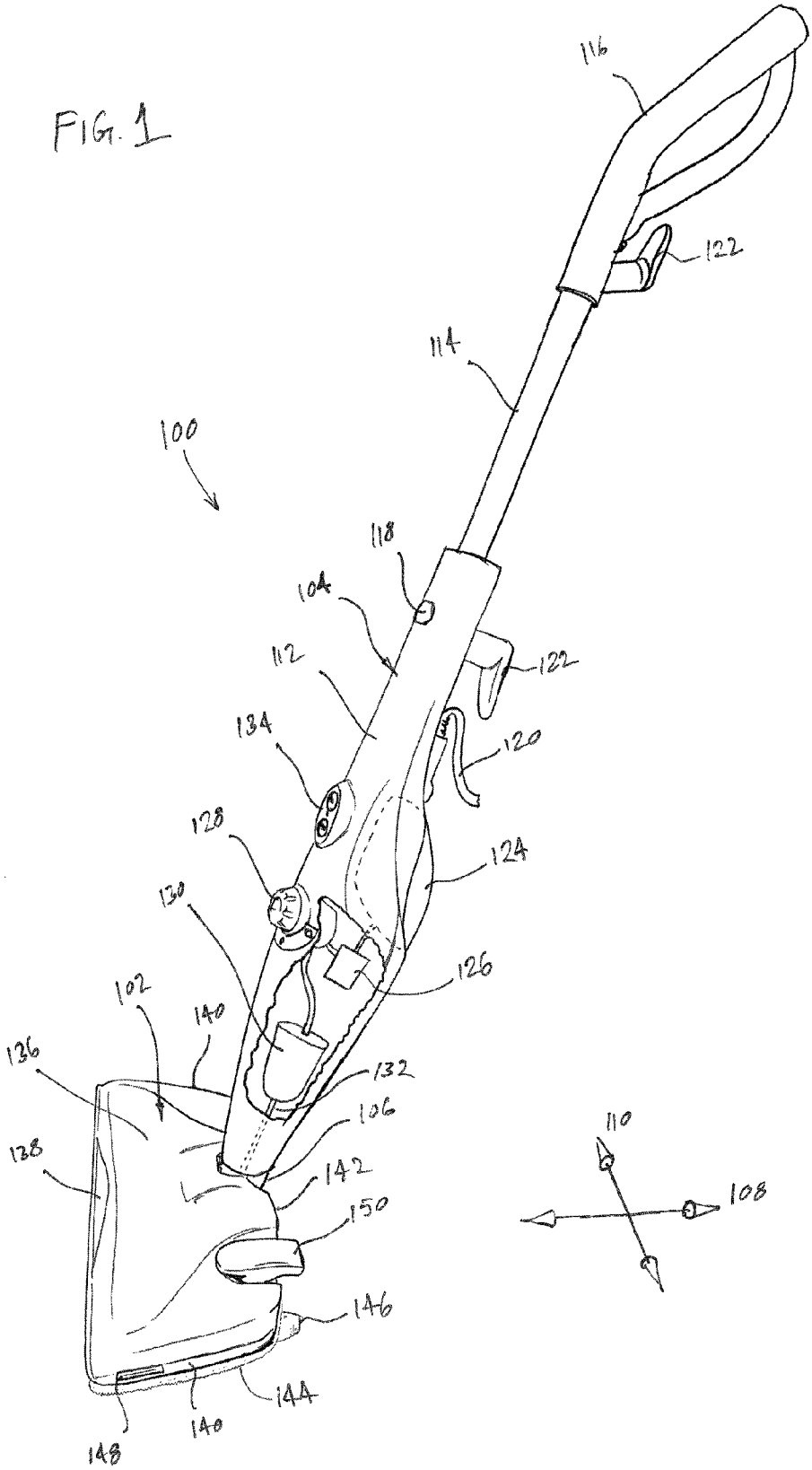
FIG. 1 is a perspective view of an exemplary steam cleaner.

An example of a steam cleaner 100 is shown in FIG. 1. The steam cleaner 100 includes a base 102 to which an operating handle 104 is attached to extend upwards from the base 102. The handle 104 may be connected to the base 102 by a fixed connection, but it is more preferred to use a pivoting joint 106. For example, the pivoting joint 106 may comprise a single-pivot joint that permits the handle to be leaned backwards. As another example, the pivoting joint 106 may comprise a multiple-pivot joint, such as shown in U.S. Pat. No. 8,052,342, that allows leaning in both the fore-aft direction 108 and the lateral direction 110. A multiple-pivot joint also may use a swivel that permits relative axial rotation between two parts, such as shown in U.S. Patent Publication No. 2011/0219581, which is incorporated herein by reference. The design of single- and multiple-pivot joints is conventional and need not be described further herein.

The handle 104 may comprise a main housing 112 that is connected at its bottom end to the base 102, an extension rod 114 that is connected to the top end of the main housing 112, and a grip 116 that is connected to a top end of the rod 114. The rod 114 optionally may be removable from the main housing 112 by depressing a catch 118 or another mechanism, as known in the art. In other embodiments, the handle 104 may comprise a different arrangement of housings and the like. For example, the handle 104 may comprise a centrally-located pivot to allow the handle 104 to be folded over on itself, a telescoping handle, or a single rigid housing with an integrally-formed grip. Other variations and modifications will be apparent to persons of ordinary skill in the art in view of the present disclosure.

Power is supplied to the steam cleaner 100 by an electrical cord 120 that is selectively connected via a plug to a wall outlet or other power source. Household electrical mains provide a relatively large power source that may be desirable for operating the steamer, but other embodiments may use batteries or portable power supplies provided the energy output is sufficient to generate the desired fluid heating capacity. The cord 120 may be stored on hooks 122 provided on the handle 104, as known in the art.

A fluid tank 124 is provided on the handle 104, or, alternatively, on the base 102. The tank 124 is configured to retain a fluid, such as water or a water mixture containing detergents, decalcifying agents, or other chemicals. The tank 124 may be permanently mounted (i.e., not removable without performing a service-level disassembly of the device, or without destroying connections or parts), or mounted to allow user removal. Where the tank 124 is permanently mounted, it includes a fill opening accessible to the user to allow refilling. Where the tank 124 is removable, the tank 124 may be connected to the rest of the fluid system by a dry-break valve or membrane that closes the tank upon removal, and the fill opening may be integrated into the dry-break valve or provided as a separate openable passage into the tank 124. Such arrangements are known in the art.

The fluid tank 124 is fluidly connected to a pump 126 that sucks fluid out of the tank 124 and conveys the fluid downstream. The pump 126 preferably comprises a conventional electric pump that mates an electric motor to a positive displacement pump (e.g., peristaltic), a centrifugal pump, or the like. Such pumps are known in the art, and the selection of a pump having suitable operation and flow characteristics to suit the overall product design will be apparent and routine to a person of ordinary skill in the art in view of the present disclosure. In alternative embodiments, the pump 126 may be a user-operated manual pump. In other alternative embodiments, the pump 126 may be omitted, and the necessary flow may be provided by gravity, by generating a positive pressure in the fluid tank 124, or by other means. Other variations and modifications will be apparent to persons of ordinary skill in the art in view of the present disclosure.

A flow regulator 128 may be provided up- or downstream of the pump 126 to control the volume of fluid passing through the system. One example of a flow regulator 128 is a bypass valve located downstream of the pump 126 that can be adjusted to redirect a variable portion of the fluid provided by the pump 126 back into the fluid tank 124 or to another location upstream of the pump 126 (useful for positive displacement pumps, for example). Another example of a flow regulator is a simple throttle valve, which may be more suitable for centrifugal pumps. A flow regulator 128 also may be provided in the form of a mechanism that varies the stroke of a shaft that drives a reciprocating pump 126, or that varies the size of the pump's operating plenum chamber. Other varieties of flow regulators may be used in other embodiments. In the shown embodiment, the flow regulator 128 also includes a knob on the outside of the main housing 112 by which the flow regulator can be controlled by the user.

A steam generator 130 is provided in the handle 104, as shown, or alternatively in the base 102. The steam generator 130 is an electrically-operated heater associated with a fluid passage or chamber. The fluid from the tank 124 is pumped through the steam generator 130 passage or reservoir to be heated by the heater. The fluid may pass continuously or intermittently through the steam generator 130, and the steam generator 130 may be operated in automatic power cycles to periodically heat fluid in an associated internal or external reservoir. In a preferred embodiment, the steam generator 130 is an "on-demand" heater that heats fluid into steam in an internal passage, but does not contain a separate reservoir for steam or heated fluid. An example of such a device is shown in U.S. Pat. No. 6,571,421, which is incorporated herein by reference. Such a device is relatively light and more compact than units having a reservoir. Alternatively, the steam generator 130 may be have a reservoir, like the device shown in U.S. Pat. No. 6,584,990, which is also incorporated herein by reference. Other steam generator devices may be used in other embodiments, and such variations and modifications will be apparent to persons of ordinary skill in the art in view of the present disclosure.

The steam generator 130 produces a periodic or continuous flow of steam through the steam cleaner 100. The term "steam," as used herein, is intended to include both pure gaseous phase water, and combinations of gaseous and liquid phase water. Condensation (e.g., misting and surface condensation) and imperfect heating are likely to result in a combination of gaseous and liquid phase water during a variety of normal operating circumstances. The steam also may be superheated, pressurized, saturated, or have other steam properties.

Steam generated by the steam generator 130 is directed to the base 102 by a steam hose 132. Hoses downstream of the steam generator 130 may be reinforced to prevent bursting under high pressure. Other fluid connections in the handle 104 (e.g., between the tank 123, pump 126 and flow regulator 128) may be formed by other hoses. The steam hose 132 and other fluid connections also may be formed by passages through rigid pipes or housing members, rather than using flexible hoses.

The pump 126 and steam generator 130 may be operated by any suitable control or controls. In the exemplary embodiment of FIG. 1, a power switch assembly 134 is provided on the handle's main housing 112, but it may instead be on the grip 116 or base 102. The power switch assembly 134 is wired to simultaneously activate or deactivate both the pump 126 and the steam generator 130, so that both always operate at the same time. To this end, the power switch assembly may include a rocker switch, a momentary on switch working with a suitable control circuit, separate "on" and "off" controls, or other control mechanisms as known in the art. In other embodiments, separate controls may be provided for the pump 126 and steam generator 130. The steam cleaner 100 also may include controls to operate the pump 126 at different speeds, to operate the steam generator 130 at different temperatures, and so on. The steam cleaner 100 also may include operation indicators, such as lights to indicate standby and operating modes, fault conditions, fluid level, temperature, and so on. In an alternative embodiment, the power switch assembly 134 may be omitted, and operation of the pump 126 or steam generator 130 may be controlled simply be plugging in or unplugging the electrical cord 120. For example, the steam generator 130 may be energized when the electrical cord 120 is plugged into a power outlet to start steam generation immediately, and the pump 126 may be operated separately by a power switch assembly 134. A status light indicating that the device is plugged in and steam is being generated may be desirable in such an embodiment.

Figure 2:
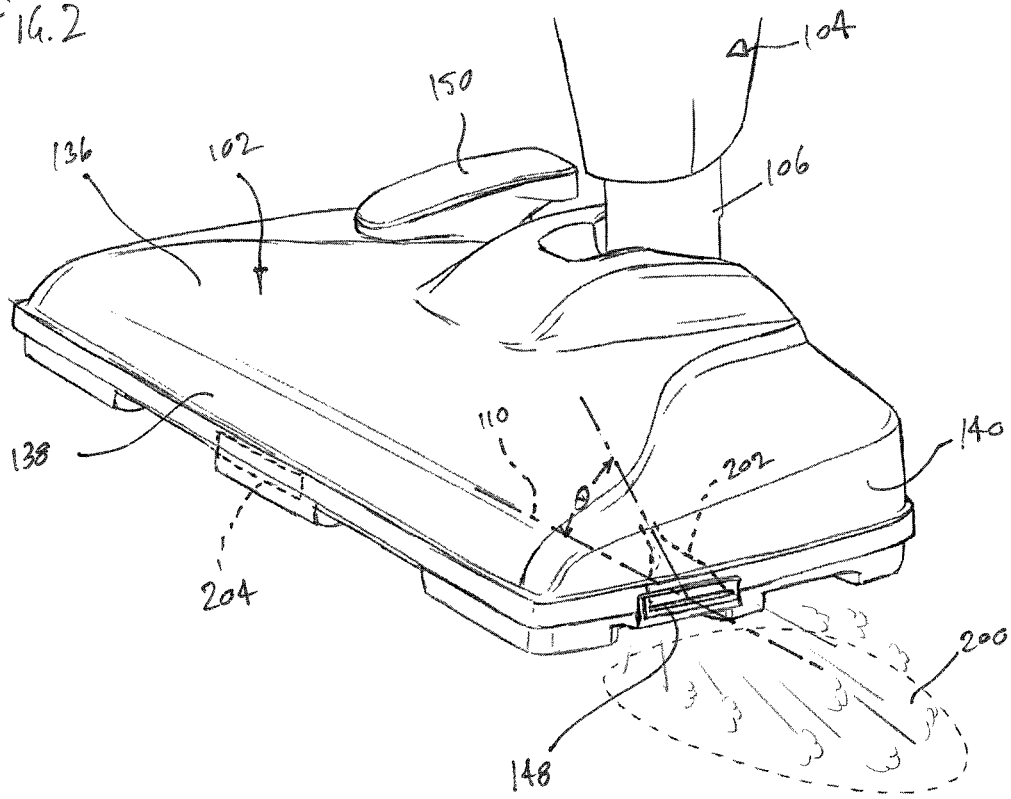
FIG. 2 is an isometric side view of the base of the steam cleaner of FIG. 1.
Figure 3:
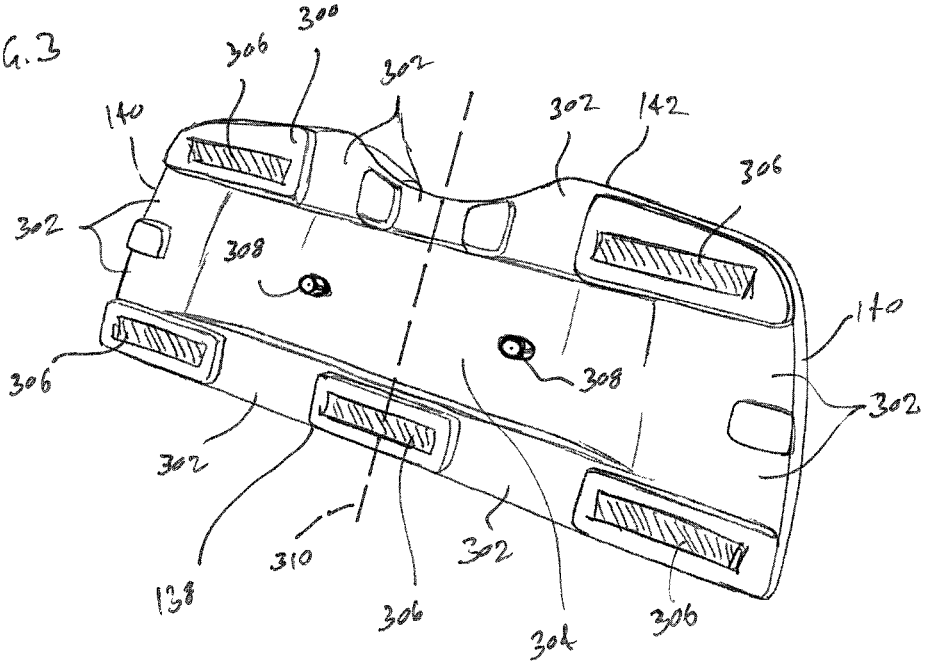
FIG. 3 is a perspective view of the bottom of the base of the steam cleaner of FIG. 1.

Referring also to FIGS. 2 and 3, the base 102 comprises an arrangement of housing members to form any suitable shape. The shown base 103, has upper and lower "clamshell" housings that collectively form a generally rectangular base 102 having a bottom 300, a top 136, and a sidewall that forms an outer perimeter of the base 102. The outer perimeter in the shown embodiment is formed by a front wall 138 that extends in the lateral direction 110, end walls 140 that extend backwards in the fore-aft direction 108 from the front wall 138, and a back wall 142 that joins the two end walls 140.

In this example, the base 102 has a relatively small maximum dimension in the fore-aft direction 108, and a relatively large maximum dimension in the lateral direction 110, so that, overall, the base 102 is elongated in the lateral direction 110. Other embodiments may use different overall shapes for the base 102, such as square, round triangular or notched (e.g., V-shaped). The handle 104 (particularly the grip 116), joint 106, and base 102 may be constructed to suggest and facilitate movement in the fore-aft direction 108, as known in the art. Fixed-axle wheels (not shown) also may be added to guide the base 102 in a particular direction, if desired. Use of a multiple-pivot joint 106 may help with steering the base 102, and may help the base 102 to be operated in virtually any direction provided there are no movement controlling features such as fixed-axle wheels that resist movement in all but the rolling direction.

The base bottom 300 may have any suitable shape, but preferably is configured to rest on a surface to be cleaned. The range of surfaces that may be cleaned is not limited, and such surfaces may include wood (hardwood, parquet, etc.), tile (ceramic, polymeric, granite, stone marble, slate, etc.), vinyl, linoleum, metal, concrete, and so on. In a preferred embodiment, the bottom 300 is generally flat, such that it contacts an intended flat target surface at multiple points. The bottom 300 also may be shaped and sized to hold the entire steam cleaner 100 upright when the handle 104 is in an upright position and the steam cleaner 100 is unattended. In the example shown in FIG. 3, the bottom 300 of the base 102 is generally flat, but includes one or more channels 302 around the perimeter of the base 102, and a shallow concave central region 304.

The bottom 300 of the base 102 also may include cleaning pad retainers 306, such patches of hook-and-loop type fabric that engage corresponding fabric on the top of a cleaning pad 144. The cleaning pad 144 may generally match the shape of the outer perimeter of the base 102, as shown in FIG. 1, or have other shapes. The cleaning pad 144 also may include a tab 146 upon that the user can step on or grasp to remove the cleaning pad 144 from the base 102. Other embodiments may omit the cleaning pad 144, or mount the cleaning pad 144 in other ways, such as by clips or hook-and-loop connectors located on the side walls or top 136 of the base 102. The cleaning pads 144 may comprise any suitable material, such as a woven or nonwoven fabric or assembly of fabrics that may be chemically treated or provided with detergents or absorbing compositions. Other variations and modifications will be apparent to persons of ordinary skill in the art in view of the present disclosure.

The base 102 includes a steam distribution system that controls how the flow of steam from the steam generator 130 is directed to the surface being cleaned. The steam distribution system includes a bottom steam distributor that directs steam generally directly below the base 102, and a side steam distributor that directs steam to the side of the base 102.

In the exemplary embodiment of FIGS. 1-3, the bottom steam distributor includes a pair of bottom spray nozzles 308. Each bottom spray nozzle 308 may comprise a diffuser cone formed as a shallow-angle cone having a single steam vent located in the center of the cone. Such diffuser cones may help distribute the steam, but other vent shapes may be used in other embodiments. For example, the bottom spray nozzles 308 may comprise simple round openings, slots, fine arrays of perforations, screens, porous weaves, and so on.

The bottom spray nozzles 308 may be located on opposite sides of a lateral centerline 310 of the base 102, and may be positioned generally centrally with respect to the fore-aft dimension of the base 102. In this example, the bottom spray nozzles 308 are located in the shallow concave central region 304 of the base 102, which forms a plenum to collect and distribute the steam emitted from the bottom spray nozzles 308. When the base 102 is covered by a cleaning pad 144, the bottom spray nozzles 308 direct the steam towards an upper surface of the cleaning pad 144, and the shallow concave central region 304 provides a partial enclosure to allow the steam to distribute over a larger area of the cleaning pad 144 before it permeates through the cleaning pad 144 to the underlying surface located below the perimeter of the base 102 (by which time some or all of the steam may have condensed to hot water). The channels 302 may be provided to offer lateral travel paths to distribute the steam further across the cleaning pad 144. Other embodiments may use other types, numbers, and locations of bottom spray nozzles. The bottom steam distributor also may have a single bottom spray nozzle.

The exemplary side steam distributor in FIGS. 1-3 comprises one or more side spray nozzles 148 located to distribute the steam flow towards a side region 200 located outside the outer perimeter of the base 102. The side region 200 is illustrated in FIG. 2 by a dashed line boundary, but it will be appreciated that the region's shape and size can vary depending on operating conditions, such as steam pressure and temperature, orientation of the base 102, and so on. The geometry of the side region 200 may be controlled to some degree by modifying the shape of the side spray nozzle 148. In the shown embodiment, the side spray nozzle 148 comprises a slot that is elongated and horizontal (i.e., generally parallel to both the fore-aft and lateral directions 108, 110 and to the surface being cleaned when the base 102 is placed thereon). This slot shape helps direct the steam flow to a side region located close to the base 102, and may be preferred to concentrate the steam flow into a relatively compact side region 200 and to minimize loss of the steam by dissipation into the surrounding atmosphere. The side spray nozzle 148 is oriented to direct the steam generally perpendicular to the fore-aft direction 108, but it will be appreciated that portions of the steam flow will diverge from the true geometric perpendicular direction due to the natural dispersion of the steam.

While the foregoing side spray nozzle 148 is preferred in one embodiment, other embodiments may use other types of spray nozzle. For example, the side steam distributor may comprise a shorter slot or a round orifice, which may be used to provide a narrower side region 200, or project the steam flow further from the side of the base 102. It also may be desirable to provide multiple side spray nozzles 148 to increase the size of the side region 200. Other alternatives will be understood with routine experimentation. The side spray nozzle 148 also may be mounted in other locations, such as on the top 136 or bottom 300 of the base 102.

The side spray nozzle 148 also may be located at the end of an internal passage 202 that is oriented at an angle θ with respect to the lateral direction 110 or the fore aft direction 108 (or both). This construction directs the steam flow at a downward angle to help control the location and shape of the side region 200, and may help prevent dissipation of the steam into the surrounding atmosphere. In a preferred embodiment, the angle θ is about 10° to about 80°, and more preferably about 20° to about 60° (angles are measured relative to a horizontal plane defined by the fore-aft and lateral directions 108, 110), but other values may be used in other embodiments.

The side region 200 may be located anywhere around the perimeter of the base 102. In the embodiment of FIGS. 1-3, the side spray nozzle 148 is on an end wall 140 of the base 102, and the side region 200 is adjacent the same end wall 140. The steam exits the side spray nozzle 148 and is deposited in the side region 200, which may be spaced from or abut the side wall 140. It will be appreciated that a portion of the steam exiting the side spray nozzle 148 also may dissipate or fall downwards and pass outside the side region 200 and under the outer perimeter of the base 102. While such may happen in normal use, it is preferred for the majority of the steam to be deposited in the side region 200 outside the perimeter of the base, as this provides several advantages. For example, depositing the steam in the side region 200 gives the user a clear visual indication that the steam is exiting the base 102, and lets the user see where the steam is deposited on the underlying surface. This provides a significant advantage over devices that only direct steam downward within the perimeter of the base, which provide little or no feedback to assist the user. Distributing the steam outside the confines of the base 102 also allows the steam to be more concentrated than it would be if it were required to dissipate and pass through a cleaning pad 144, and this helps accelerate the cleaning process. Furthermore, in embodiments in which the side region 200 is located on a lateral side of the base 102, the steam is allowed time to condense into a hot water and soak into the underlying surface for a moment before the user moves the base 102 over to clean the side region 200.

By way of further explanation, in typical circumstances, an user of an electric floor cleaning appliance, such as a steam cleaner 100 or an upright vacuum cleaner, will move the device generally along the fore-aft direction 108 in a back-and-forth motion. This motion is a natural, low-energy motion accomplished by moving the arm back and forth. In contrast, a sweeping, side-to-side movement in the lateral direction 110 is more difficult, particularly because the appliance typically does not have an elongated handle that allows a two-handed grip to facilitate such sweeping. Sweeping motion also may not be encouraged by the shape of the grip 116, which often is a single-handed curved shape. Sweeping also is difficult if the base 102 includes fixed-axle wheels that do not freely roll in the lateral direction 110. As a result of these ergonomic and structural considerations, movement in the fore-aft direction 108 is the norm, and the base 102 typically is displaced in the lateral direction 110 by slightly rotating is between or during cleaning strokes. Placing the side steam distributor on the end wall 140 of the base 102 takes advantage of this situation by depositing the steam to the side of the base 102 so that it can soak in for as long as it takes to move the base 102 laterally to pass over the treated area.

Another benefit of locating the side region 200 adjacent a lateral end of the base 102 is that it facilitates combined use with steam cleaner 100 that incorporate a vacuum system with a suction nozzle in the base 102. Steam cleaners having integrated vacuum systems, such as shown in U.S. Pat. No. 6,571,421, may be operable in only one of the two modes (vacuuming or steaming) at any given time, due to the fact that the vacuum may ingest the steam before it is deposited for effective cleaning. If the steam is ingested, it reduces cleaning effectiveness and may result in damage to the suction motor as the steam condenses in the dirt receptacle. Directing the steam to a lateral end of the base 102 reduces and may effectively eliminate the risk that the vacuum will ingest the steam, and allows simultaneous steaming and vacuuming.

In use, the user may place the steam cleaner 100 in the bottom steam distribution mode to distribute the steam within the perimeter of the base 102 and through the cleaning pad 144 (if provided) to clean relatively large areas with greater speed. When the user identifies a spot that is or may be difficult to remove, the user may place the steam cleaner 100 in the side steam distribution mode to spray steam on the spot. The user can accurately aim the steam because he or she can see it emitting from the base 102. The use then places the steam cleaner 100 back in the bottom steam distribution mode and moves the base over the treated spot to complete cleaning. Other methods of using the steam cleaner 100 also will be apparent to persons of ordinary skill in the art in view of the present disclosure.

Despite the benefits of spraying the steam to a lateral side of the base 102, it is envisioned that other embodiments may locate the side steam distributor in front of or behind the base 102, or at corners of the base 102. For example, an alternative side steam distributor 204 may be located on the front wall 138 and oriented to direct the steam flow generally parallel with the fore-aft direction 108. Such constructions may seem more natural to users who expect the cleaning operation to take place entirely during the fore-aft cleaning stroke, and may offer other benefits. However, such embodiments may not provide as much soaking time and may ultimately require more cleaning effort. To mitigate this, a side steam distributor that projects steam forward may be mounted on a stalk to place the steam further ahead to allow more time to soak in, or otherwise modified to project the steam a greater distance ahead of the base 102. Other embodiments may have a triangular base 102 with the apex located at the front of the base 102 and one or more side spray nozzles 148 that direct steam to side regions 200 adjacent the sides extending from the apex. Other variations and modifications will be apparent to persons of ordinary skill in the art in view of the present disclosure.

The steam distribution system preferably includes a flow controller to direct the steam flow to the bottom steam distributor and the side steam distributors. The flow controller preferably is operable to direct all of the steam flow to either of the two distributors, and optionally may have intermediate settings in which a portion of the steam flow is directed to each distributor. In other embodiments, the flow controller may only operate to periodically redirect a portion of the steam flow to the side steam distributor while the remainder of the flow passes to the bottom steam distributor. Other variations and modifications will be apparent to persons of ordinary skill in the art in view of the present disclosure.

In the exemplary embodiment shown in FIGS. 4, 5A and 5B, the flow controller comprises a steam valve 400 having a valve inlet 402, a first valve outlet 404, and a second valve outlet 406. The inlet and outlets comprise openings into a valve chamber 500, and may be formed as rigid pipes, flexible hoses, or any combination thereof. The valve inlet 402 is fluidly connected to the outlet of the steam generator 130 to receive a flow of steam. The first valve outlet 404 is fluidly connected to the two bottom spray nozzles 308 of the bottom steam distributor by separate branch passages 408 that extend from a T-connector or the like. If desired, an additional flow control valve can be provided to select which of the two branch passages 408 will receive the steam flow. The second valve outlet 406 is fluidly connected to the side spray nozzle 148. If there are multiple side spray nozzles 148, the second valve outlet may include branch passages and a selector valve. The valve outlets 404, 406 also may include flow regulators (e.g., throttle valves or restrictors) to control the steam flow rate, if desired.

A valve seal 502 is located inside the valve chamber 500, and mounted on a movable actuator 504. The valve seal 502 is configured to selectively block fluidly communication between the valve inlet 402 and the second valve outlet 406 (FIG. 5A), or the first valve outlet 404 (FIG. 5B). By blocking fluid communication to one of the two outlets 404, 406, the valve 400 permits steam flow to the other outlet 404, 406. The exemplary valve seal 502 comprises an O-ring or similar perimeter seal that seals against an inner surface of the valve chamber 500. The actuator 504 comprises a sliding plunger that extends outside the valve chamber 500 through a sealed opening to permit external operation. Such valve arrangements are known in the art and need no further description herein.

Alternative embodiments of flow controllers may use other types of steam valve system. For example, the shown valve 400 may be replaced by a rotary or flapper valve. In still other embodiments, the flow controller may be provided in the form of mechanisms that selectively block flow from the steam generator 130 to the bottom steam distributor and the side steam distributor. In such an embodiment, the steam generator 130 may be fluidly connected to the bottom steam distributor and the side steam distributor by respective pliable hoses, and a mechanism may be provided to pinch one hose or the other to close flow along the pinched hose. The flow controller also may have separate respective valves to control flow to the bottom and side steam distributors to provide independent operation of both, or have other valve systems that allow simultaneous or blended operation modes. It will also be appreciated that the flow controller may be located in the handle 104, instead of the base 102, but such construction would require the provision of at least two steam passages (one for bottom steam distribution, and another for side steam distribution) from the handle 104 to the base 102. Another variation may place part of the flow controller (e.g., a valve) on the base 102, and another part (e.g., an operating lever) on the handle 104. Other variations and modifications will be apparent to persons of ordinary skill in the art in view of the present disclosure.

Figure 6:
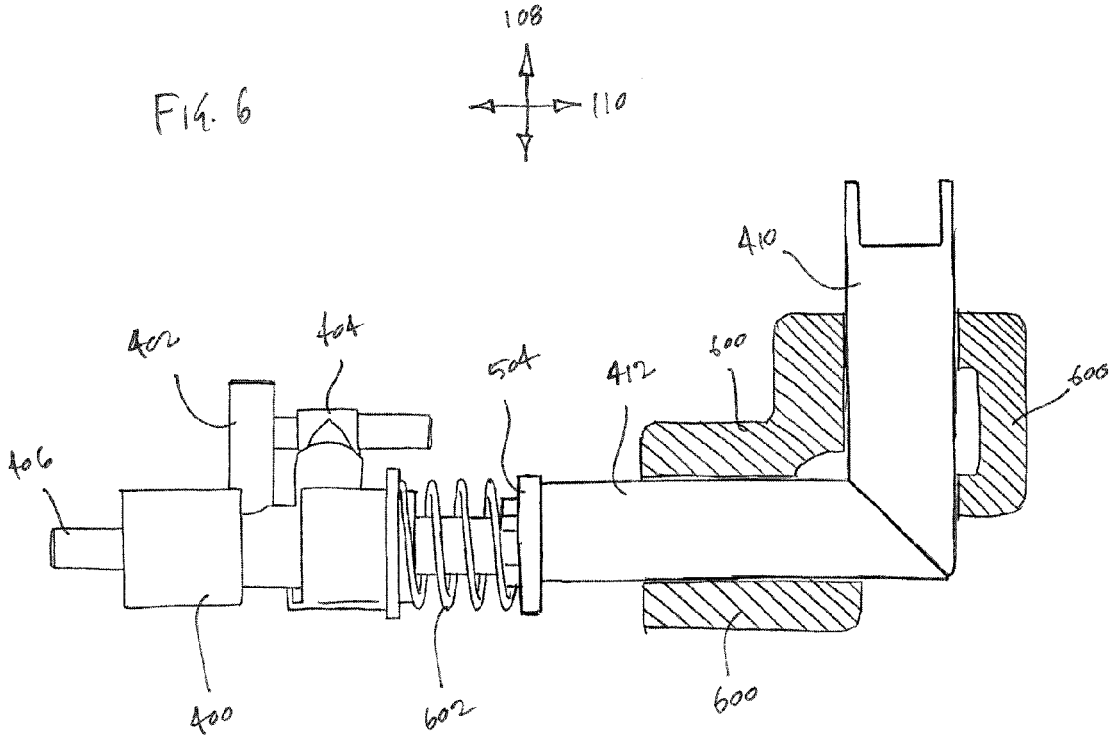
FIG. 6 is a bottom view of an exemplary linkage assembly that may be used to operate a steam valve.

The flow controller may be operated by a foot pedal 150, hand-operated knob, a solenoid, or any other suitable mechanism. The exemplary embodiment uses a foot pedal 150 that is operatively connected to the steam valve 400 by a linkage that translates movement of the foot pedal 150 into movement of the actuator 504 and seal 502. Referring to FIGS. 4 and 6, the linkage may comprise a first slide 410 that moves in the fore-aft direction 108 and a second slide 412 that moves in the lateral direction 110. The second slide 412 abuts, and may be connected to, the actuator 504. The ends of the first and second slides 410, 412 contact one another along a diagonal cam interface, such that sliding the first slide 410 forwards (downwards in the Figure) moves the second slide 412 laterally to the left. This movement operates the actuator 504 to move the valve 400 from a first operating position (e.g., bottom steam distribution for mopping) to a second operating position (e.g., side steam distribution for spot cleaning). The first and second slides 410, 412 are retained by sliding mounts 600 to prevent them from diverging from their desired linear movement paths.

A spring 602 may be provided to bias the actuator 504 (and thus the linkage and foot pedal 150) back towards the first operating position. A snap or other friction contact, a catch, an over-center arrangement of moving parts, or any other suitable mechanism may be used to hold the actuator 504 in the second operating position. Alternatively, the flow controller may be configured to pull the actuator 504 back to the first operating position upon further operation of the foot pedal 150. For example, the foot pedal 150 may be rocked to a forward position to provide bottom steam distribution, and rocked to a backward position to provide side steam distribution. Other systems may use a linkage arrangement in which successive depressions of the foot pedal 150 in the same direction change the mode back and forth from side to bottom steam distribution. As another alternative, the actuator 504 may freely return to the first operating position when the user stops applying pressure to the foot pedal 150.

Figure 7:
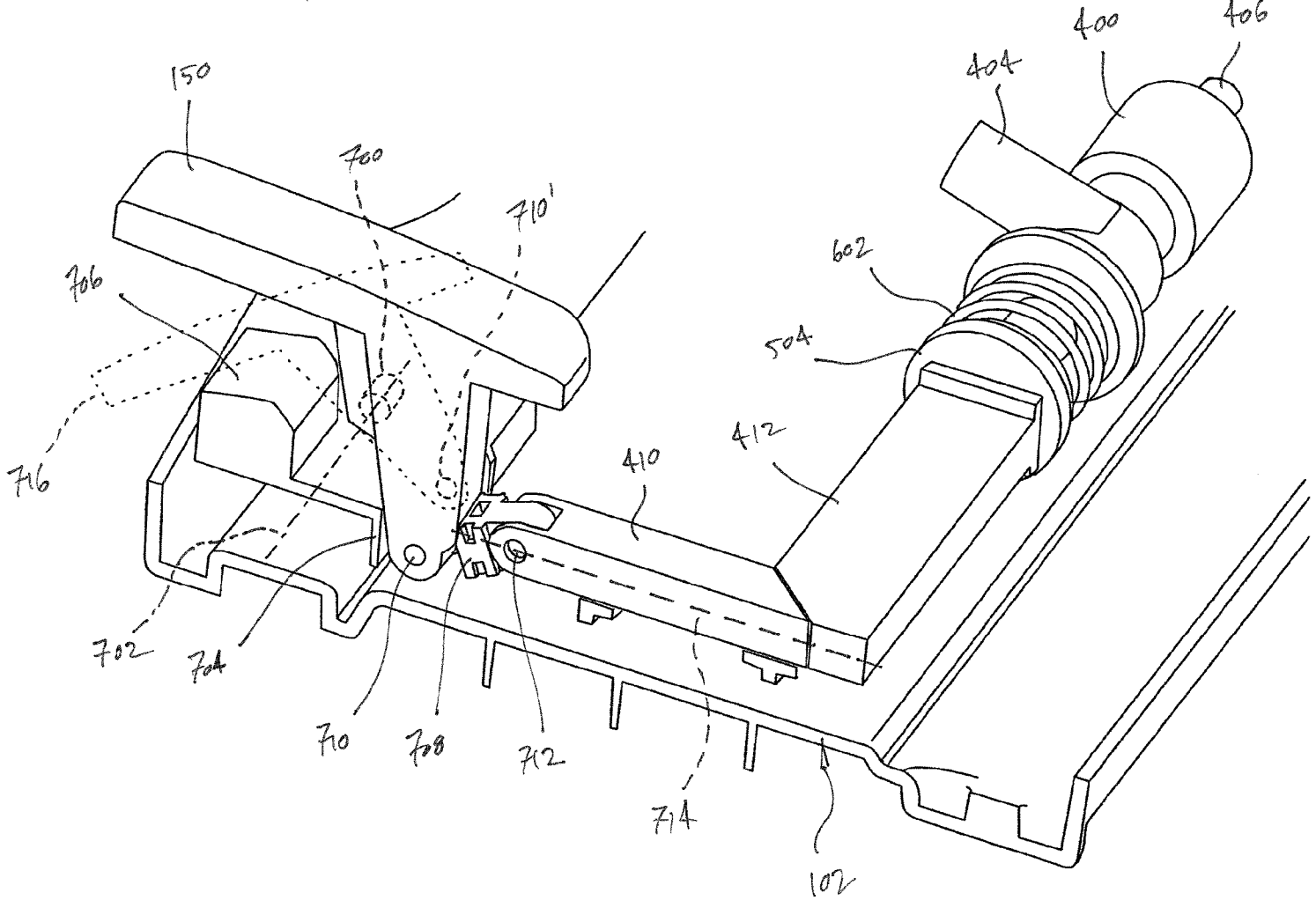
FIG. 7 is a partially cut away isometric top view of the linkage assembly of FIG. 6.

FIG. 7 illustrates and example of a foot pedal 150 and how it interacts with the slides 410, 412 and valve 400. In this embodiment, the foot pedal 150 is mounted to the base 102 by a pivot 700 to rotate about a pivot axis 702. Rotation of the foot pedal 150 is limited by a first travel stop 704 that prevents forward rotation past a predetermined point, and a second travel stop 706 that prevents rearward rotation past a predetermined point. The foot pedal 150 is connected to the first slide 410 by an intermediate link 708. The intermediate link 708 is rotatably connected to the foot pedal 150 by a first pivot 710, and to the first slide 410 by a second pivot 712.

The foot pedal 150 is operated by moving forward to a first position where it abuts the first travel stop 704 or rearward to a second position where it abuts the second travel stop 706. In this position, the first pivot 710 of the intermediate link 708 is located on a first side of the sliding axis 714 of the first slide 410. A restoring force applied by the spring 602 against the second slide 412 will push the first slide 410 backwards along its sliding axis 714, thereby creating a biasing force at the second pivot 712. The biasing force is directed along the intermediate link 708 to bias the foot pedal 150 into the first position. Thus, an operator seeking to move the foot pedal 150 out of the first position must apply sufficient force to compress the spring 602 at least some small amount. Similarly, when the foot pedal 150 is in the second position, as shown by the dotted line 716, the first pivot 710 is located above the sliding axis 714 of the first slide 410 (this location is shown by reference number 710'), and the spring 602 applies a force that is transmitted to the intermediate link 708 to hold the foot pedal 150 in the second position. Again, the user must apply a force to overcome the spring 602 to move the foot pedal 150 out of the second position. As will be apparent from the foregoing, the intermediate link 708 and its pivots 710, 712 are arranged to provide an "over center" lock to resiliently hold the foot pedal 150 in the first and second positions.

With this arrangement, the foot pedal 150 can be rotated between two pedal positions to selectively move the valve 400 between the first operating position (bottom steam distribution) and the second operating position (side steam distribution). FIG. 7 illustrates the first pedal position used for bottom steam distribution, and the second pedal position is shown as a dotted line 716. When the foot pedal 150 is in the first position, the first pivot 710 is positioned to place the valve 400 in the bottom steam distribution position (e.g., FIG. 5A). With the foot pedal 150 in the second position, the first pivot 710 is positioned to place the valve 400 in the side steam distribution position (e.g., FIG. 5B). In this case, the first pivot 710 is moved further forward to place the valve 400 in the side stream distribution position, but other arrangements may be used. Other variations and modifications will be apparent to persons of ordinary skill in the art in view of the present disclosure.

Referring back to FIG. 4, an example of a multiple-pivot joint 106 that may be used to join the base 102 to the handle 104 is shown and described. The joint 106 includes a lower joint member 414 having a pair of lateral trunnions 416 that extend in the lateral direction 110 and fit into corresponding holes (not shown) in the base 102. The trunnions 416 provide fore-aft pivoting to lean the handle 104 back during use. The joint 106 also includes an upper joint member 418 that is mounted to the lower joint member 414 by a pivot pin 420. The pivot pin 420 provides lateral pivoting to lean the handle 104 in the lateral direction 110. One or more travel locks (not shown) may be provided to prevent the fore-aft and/or lateral pivoting movements, which may be desirable to hold the handle 104 in the upright position or to change the operational dynamics of the steam cleaner 100 (e.g., locking the lateral pivot may provide a more rigid motion when desired). The joint 106 also may form a conduit for a steam passage 422 that extends from the steam generator 130 to the steam valve 400, but the steam passage may alternatively pass outside the joint 106. Other variations and modifications will be apparent to persons of ordinary skill in the art in view of the present disclosure.

The present disclosure describes a number of new, useful and nonobvious features and/or combinations of features that may be used alone or together. The embodiments described herein are all exemplary, and are not intended to limit the scope of the inventions. Persons of ordinary skill in the art will appreciate and understand that the inventions described herein can be modified and adapted in various and equivalent ways, and such modifications and adaptations are intended to be included in the scope of this disclosure and the appended claims.

I claim:

1. A steam cleaner comprising:

a base having a generally flat bottom configured to rest on a surface to be cleaned, a sidewall extending upwards from the bottom and forming an outer perimeter of the base, and a top joining the sidewall;

an operating handle connected to and extending from the base;

a fluid tank operatively associated with the handle or the base and configured to contain a fluid;

a steam generator operatively associated with the handle or the base, the steam generator being fluidly connected to the fluid tank to receive the fluid from the fluid tank and operable to convert the fluid into a steam flow;

a first control configured to selectively operate the steam generator;

a bottom steam distributor located on the bottom of the base and operable, upon activation of the bottom steam distributor, to distribute the steam flow from the bottom of the base towards a first region of the surface to be cleaned located within the outer perimeter of the base;

a side steam distributor located on the base and operable, upon activation of the side steam distributor, to distribute at least a portion of the steam flow towards a second region of the surface to be cleaned located outside the outer perimeter of the base; and a second control movable between a first position in which the second control fluidly connects the steam generator to the bottom steam distributor to activate the bottom steam distributor, and a second position in which the second control fluidly connects the steam generator to the side steam distributor to activate the side steam distributor;

wherein the generally flat bottom of the base comprises a concave central region and the bottom steam distributor is located in the concave central region.

2. The steam cleaner of claim 1, wherein the base comprises one or more connectors to selectively retain a cleaning pad between the base and the surface to be cleaned.

3. The steam cleaner of claim 2, wherein the bottom steam distributor is oriented to distribute the steam flow to an upper surface of the cleaning pad upon activation of the bottom steam distributor.

4. The steam cleaner of claim 1, wherein the operating handle is connected to the base by a pivot joint.

5. The steam cleaner of claim 1, wherein the operating handle is connected to the base by a multiple-axis pivot joint.

6. The steam cleaner of claim 1, wherein the operating handle comprises a main housing, a removable extension connected to the main housing at a location distal from the base, and a grip connected to the removable extension at a location distal from the main housing.

7. The steam cleaner of claim 1, wherein the steam generator is located in the operating handle.

8. The steam cleaner of claim 1, wherein the steam generator comprises an on-demand steam generator.

9. The steam cleaner of claim 1, wherein the steam generator comprises a steam tank.

10. The steam cleaner of claim 1, wherein the first control comprises a power cord, a power switch, a flow regulator, or a combination thereof.

11. The steam cleaner of claim 1, wherein the bottom steam distributor comprises one or more bottom spray nozzles on the bottom of the base.

12. The steam cleaner of claim 1, wherein the side steam distributor comprises one or more side spray nozzles.

13. The steam cleaner of claim 1, wherein the side steam distributor comprises a horizontal, elongated slot.

14. The steam cleaner of claim 1, wherein:

the base comprises a front wall extending in a lateral direction, a first end wall extending backwards in a fore-aft direction from the front wall, and a second end wall extending backwards in the fore-aft direction from the front wall; and the side steam distributor comprises at least one elongated slot located on the first end wall.

15. The steam cleaner of claim 1, wherein:

the base comprises a front wall extending in a lateral direction, a first end wall extending backwards in a fore-aft direction from the front wall, and a second end wall extending backwards in the fore-aft direction from the front wall; and the second region of the surface to be cleaned is located adjacent the first end wall.

16. The steam cleaner of claim 15, wherein the side steam distributor comprises one or more side spray nozzles oriented to distribute the steam flow generally perpendicular to the fore-aft direction.

17. The steam cleaner of claim 1, wherein:

the base comprises a front wall extending in a lateral direction, a first end wall extending backwards in a fore-aft direction from the front wall, and a second end wall extending backwards in the fore-aft direction from the front wall; and the second region of the surface to be cleaned is located adjacent the front wall.

18. The steam cleaner of claim 17, wherein the side steam distributor comprises one or more side spray nozzles oriented to distribute the steam flow generally parallel to the fore-aft direction.

19. The steam cleaner of claim 1, wherein the side steam distributor is located on the sidewall of the base.

20. The steam cleaner of claim 1, wherein the second control comprises a steam valve.

21. The steam cleaner of claim 20, wherein the steam valve is located on the base and the second control further comprises a foot pedal operatively connected to the steam valve.

22. The steam cleaner of claim 20, wherein the steam valve comprises:

a valve chamber having a valve inlet fluidly connected to the steam generator, a first outlet fluidly connected to the bottom steam distributor and a second outlet fluidly connected to the side steam distributor; and a valve seal located inside the valve chamber and selectively movable between a first position in which the valve seal permits fluid communication between the valve inlet and the first outlet and prevents fluid communication between the valve inlet and the second outlet to thereby activate the bottom steam distributor, and a second position in which the valve seal prevents fluid communication between the valve inlet and the first outlet and permits fluid communication between the valve inlet and the second outlet to thereby activate the bottom steam distributor.

23. The steam cleaner of claim 22, wherein the valve seal comprises a sliding plunger and an O-ring that seals against an inner wall of the valve chamber.

24. The steam cleaner of claim 20, wherein the steam valve is configured such that, upon activation of the side steam distributor, the side steam distributor distributes all of the steam flow towards the second region.

25. A steam cleaner comprising:

a base having a generally flat bottom configured to rest on a surface to be cleaned, a sidewall extending upwards from the bottom and forming an outer perimeter of the base, and a top joining the sidewall;

an operating handle connected to and extending from the base;

a fluid tank operatively associated with the handle or the base and configured to contain a fluid;

a steam generator operatively associated with the handle or the base, the steam generator being fluidly connected to the fluid tank to receive the fluid from the fluid tank and operable to convert the fluid into a steam flow;

a first control configured to selectively operate the steam generator;

a bottom steam distributor located on the bottom of the base and operable, upon activation of the bottom steam distributor, to distribute the steam flow from the bottom of the base towards a first region of the surface to be cleaned located within the outer perimeter of the base;

a side steam distributor located on the base and operable, upon activation of the side steam distributor, to distribute at least a portion of the steam flow towards a second region of the surface to be cleaned located outside the outer perimeter of the base; and a second control movable between a first position in which the second control fluidly connects the steam generator to the bottom steam distributor to activate the bottom steam distributor, and a second position in which the second control fluidly connects the steam generator to the side steam distributor to activate the side steam distributor; and wherein:

the base comprises a front wall extending in a lateral direction, a first end wall extending backwards in a fore-aft direction from the front wall, and a second end wall extending backwards in the fore-aft direction from the front wall;

the second region of the surface to be cleaned is located adjacent the first end wall; and the side steam distributor comprises one or more side spray nozzles oriented to distribute the steam flow generally perpendicular to the fore-aft direction.

26. The steam cleaner of claim 25, wherein the base comprises a cleaning pad positioned between the base and the surface to be cleaned, and the bottom steam distributor is oriented to distribute the steam flow to an upper surface of the cleaning pad upon activation of the bottom steam distributor.

27. The steam cleaner of claim 25, wherein the generally flat bottom of the base comprises a concave central region and the bottom steam distributor is located in the concave central region.

28. The steam cleaner of claim 25, wherein the steam generator is located in the operating handle.

29. The steam cleaner of claim 25, wherein the side steam distributor comprises a horizontal, elongated slot.

30. The steam cleaner of claim 25, wherein the side steam distributor is located on the sidewall of the base.

31. The steam cleaner of claim 25, wherein the second control comprises a steam valve and a foot pedal operatively connected to the steam valve.

32. A steam cleaner comprising:

a base having a generally flat bottom configured to rest on a surface to be cleaned, a sidewall extending upwards from the bottom and forming an outer perimeter of the base, and a top joining the sidewall;

an operating handle connected to and extending from the base;

a fluid tank operatively associated with the handle or the base and configured to contain a fluid;

a steam generator operatively associated with the handle or the base, the steam generator being fluidly connected to the fluid tank to receive the fluid from the fluid tank and operable to convert the fluid into a steam flow;

a first control configured to selectively operate the steam generator;

a bottom steam distributor located on the bottom of the base and operable, upon activation of the bottom steam distributor, to distribute the steam flow from the bottom of the base towards a first region of the surface to be cleaned located within the outer perimeter of the base;

a side steam distributor located on the base and operable, upon activation of the side steam distributor, to distribute at least a portion of the steam flow towards a second region of the surface to be cleaned located outside the outer perimeter of the base; and a second control movable between a first position in which the second control fluidly connects the steam generator to the bottom steam distributor to activate the bottom steam distributor, and a second position in which the second control fluidly connects the steam generator to the side steam distributor to activate the side steam distributor;

wherein the second control comprises a steam valve located on the base and a foot pedal operatively connected to the steam valve.

33. The steam cleaner of claim 32, wherein the base comprises a cleaning pad positioned between the base and the surface to be cleaned, and the bottom steam distributor is oriented to distribute the steam flow to an upper surface of the cleaning pad upon activation of the bottom steam distributor.

34. The steam cleaner of claim 32, wherein the generally flat bottom of the base comprises a concave central region and the bottom steam distributor is located in the concave central region.

35. The steam cleaner of claim 32, wherein the steam generator is located in the operating handle.

36. The steam cleaner of claim 32, wherein the side steam distributor comprises a horizontal, elongated slot.

37. The steam cleaner of claim 32, wherein:

the base comprises a front wall extending in a lateral direction, a first end wall extending backwards in a fore-aft direction from the front wall, and a second end wall extending backwards in the fore-aft direction from the front wall; and the second region of the surface to be cleaned is located adjacent the first end wall.

38. The steam cleaner of claim 37, wherein the side steam distributor comprises one or more side spray nozzles oriented to distribute the steam flow generally perpendicular to the fore-aft direction.

39. The steam cleaner of claim 32, wherein:

the base comprises a front wall extending in a lateral direction, a first end wall extending backwards in a fore-aft direction from the front wall, and a second end wall extending backwards in the fore-aft direction from the front wall; and the second region of the surface to be cleaned is located adjacent the front wall.

40. The steam cleaner of claim 39, wherein the side steam distributor comprises one or more side spray nozzles oriented to distribute the steam flow generally parallel to the fore-aft direction.

* * * * *